US010329868B2

(12) United States Patent
Limb et al.

(10) Patent No.: US 10,329,868 B2
(45) Date of Patent: Jun. 25, 2019

(54) RELEASABLY LOCKED DEBRIS BARRIER FOR A SUBTERRANEAN TOOL

(71) Applicant: BAKER HUGHES, Houston, TX (US)

(72) Inventors: Christopher J. Limb, Cypress, TX (US); Frank J. Maenza, Houston, TX (US); Nicholas S. Conner, Cypress, TX (US); Robert J. Taylor, Houston, TX (US); Gary L. Anderson, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 361 days.

(21) Appl. No.: 14/839,292

(22) Filed: Aug. 28, 2015

(65) Prior Publication Data

US 2017/0058630 A1 Mar. 2, 2017

(51) Int. Cl.

| | |
|---|---|
| ***E21B 33/12*** | (2006.01) |
| ***E21B 33/128*** | (2006.01) |
| ***E21B 33/129*** | (2006.01) |
| ***E21B 23/00*** | (2006.01) |

(52) U.S. Cl.
CPC ..... *E21B 33/128* (2013.01); *E21B 23/004* (2013.01); *E21B 33/1292* (2013.01)

(58) Field of Classification Search
CPC ..... E21B 23/06; E21B 33/1216; E21B 33/12
See application file for complete search history.

(56) References Cited

U.S. PATENT DOCUMENTS

| | | | | |
|---|---|---|---|---|
| 6,536,532 | B2 * | 3/2003 | Doane | E21B 23/01 166/121 |
| 7,604,048 | B2 | 10/2009 | Kossa et al. | |
| 8,881,802 | B2 | 11/2014 | Gorman | |
| 8,939,201 | B2 | 1/2015 | O'Malley | |
| 9,234,412 | B2 * | 1/2016 | Getzlaf | E21B 23/02 |
| 2004/0238185 | A1 | 12/2004 | Rothers et al. | |
| 2011/0108266 | A1 | 5/2011 | Smith et al. | |
| 2011/0147013 | A1 | 6/2011 | Kilgore | |
| 2014/0196912 | A1 * | 7/2014 | Turley | E21B 43/10 166/382 |
| 2014/0318765 | A1 | 10/2014 | Jordy | |

* cited by examiner

*Primary Examiner* — David J Bagnell
*Assistant Examiner* — Brandon M Duck
(74) *Attorney, Agent, or Firm* — Shawn Hunter

(57) ABSTRACT

An articulated debris barrier folds on itself to extend radially to span a surrounding annular gap when the tool associated with it is set. The debris barrier can be used with a packer or bridge plug. The set position of the packer or plug is locked and another lock holds the extended position of the debris barrier. The debris barrier lock can be a snap ring that extends into a groove brought into alignment with it during the setting. Alternatively the lock for the debris barrier can be a body lock ring. In either case, release and retrieval of the packer or plug involves undermining of the locking feature for the debris barrier so that the debris barrier can extend while retracting from the borehole wall so that the barrier and the associated packer or plug can be removed together.

20 Claims, 6 Drawing Sheets

RELEASABLY LOCKED DEBRIS BARRIER FOR A SUBTERRANEAN TOOL

FIELD OF THE INVENTION

The field of the invention is debris barriers for subterranean tools and more particularly barriers that set and lock with the tool with the lock being releasable when the tool is unset and retrieved.

BACKGROUND OF THE INVENTION

Subterranean barriers such as packers normally have a sealing element and one or more assemblies of slips that are urged into contact with a surrounding borehole wall when pushed on ramps referred to as cones. Such barriers can be left in position for a very long time and as result the debris that is in well fluids that can come from the formation or from the borehole wall can over time precipitate down to the set sealing element and the slip assembly that is located above the sealing element. Many releasable packers release with a pickup force that shears a breakable member to allow the assembly of the seal and the slips and associated cones to stretch out. This movement allows the slips to ride down the cones and retract away from a gripping relationship with the surrounding tubular that defines the borehole wall.

To keep parts that need to move with respect to each other clear of debris, packers have been provided with debris barriers that span an annular gap between the packer outer assembly and the surrounding borehole wall. These debris barriers are usually folding structures when viewed in section whose ends are brought together to bring the folds together with the result that the barrier extends radially to span the surrounding gap to the tubular defining the wellbore wall. These devices are deployed after the packer sets and set down weight is applied. One problem with such designs is that due to loading changes or thermal effects that alter the length of the string, the amount of set down weight is variable and can actually disappear. Other designs compress the debris barrier as a result of the same piston movement that sets the slips and seal. However, even in these instances with loading to a predetermined level in a given direction, the compressive force that holds the debris barrier extended can be overcome which leads the barrier to retract and pass debris. This can lead to retraction of the barrier and admission of the debris onto closely fitting relatively moving parts which can then result in their jamming. When that happens the packer may not release and a milling operation could result to get the packer out of the hole. One attempt to address this problem is to unleash the potential energy of a spring against the barrier after the packer is set to help insure that the debris barrier stays folded even when the amount of set down weight on the debris barrier is sharply reduced or eliminated due to thermal effects or other operational reasons. Such a design is shown in U.S. Pat. No. 7,604,048. Fixed dimension debris barriers are shown in U.S. Pat. No. 8,881,802. A weight set debris barrier is shown in U.S. Pat. No. 8,474,522. Axially shifted foam sleeve that are brought into a zone of smaller dimension to span an annular gap are shown in U.S. Pat. No. 8,939,201.

What is needed and provided by the present invention is an articulated debris barrier that is selectively extended to span a surrounding annular gap when a tool such as a packer is set. The extended position of the debris barrier is then releasably locked in when the tool such as a packer is in service. When the tool is released for retrieval the lock on the debris barrier is released so that it can be retracted. This allows the barrier and the tool to be removed without hanging up or damaging the debris barrier. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

An articulated debris barrier folds on itself to extend radially to span a surrounding annular gap when the tool associated with it is set. The debris barrier can be used with a packer or bridge plug. The set position of the packer or plug is locked and another lock holds the extended position of the debris barrier. The debris barrier lock can be a snap ring that extends into a groove brought into alignment with it during the setting. Alternatively the lock for the debris barrier can be a body lock ring. In either case, release and retrieval of the packer or plug involves undermining of the locking feature for the debris barrier so that the debris barrier can extend while retracting from the borehole wall so that the barrier and the associated packer or plug can be removed together.

DETAILED DESCRIPTION OF THE PREFERRED EMBODIMENT

Figure 1:
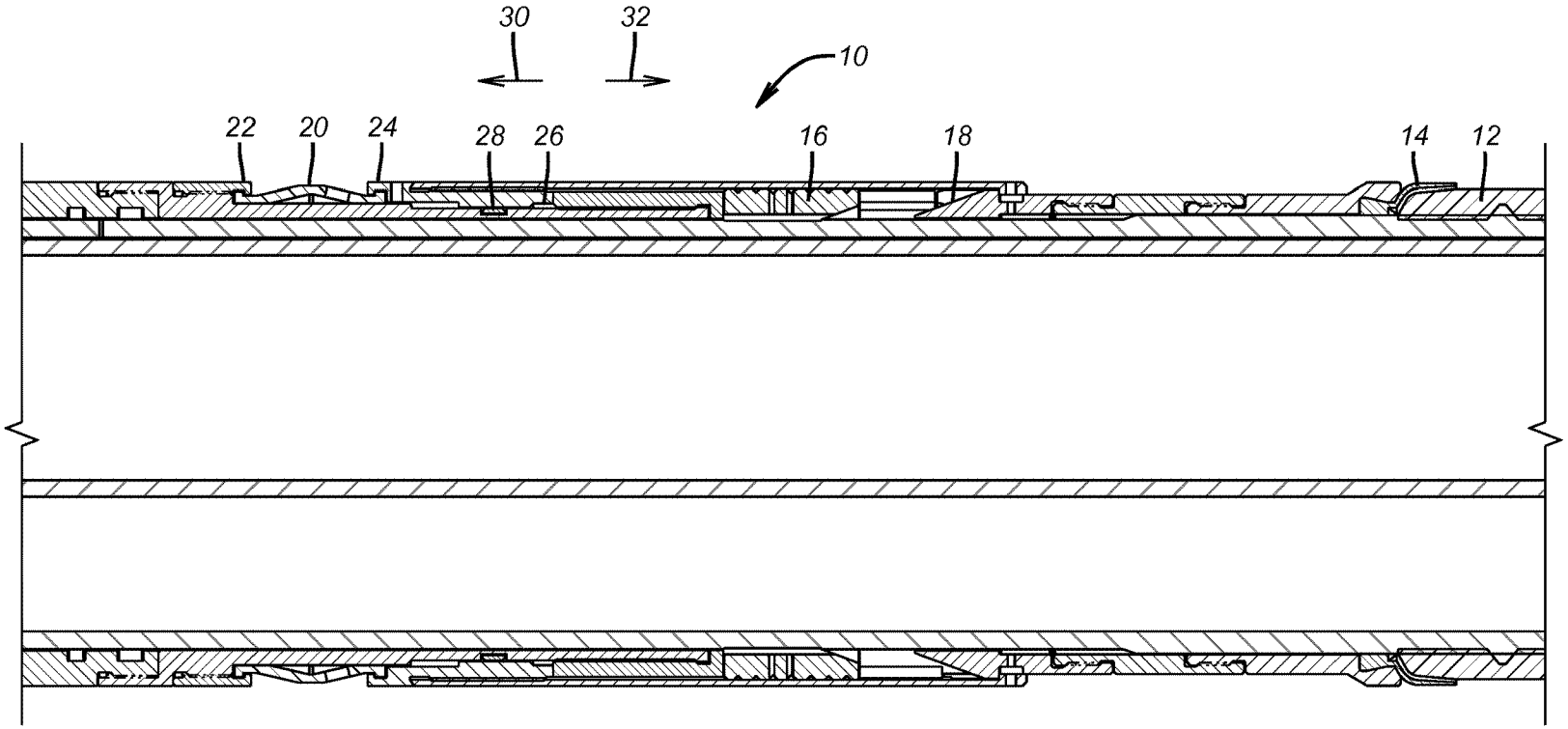
FIG. 1 is a section view of the snap ring locking debris barrier in the run in position.
Figure 2:
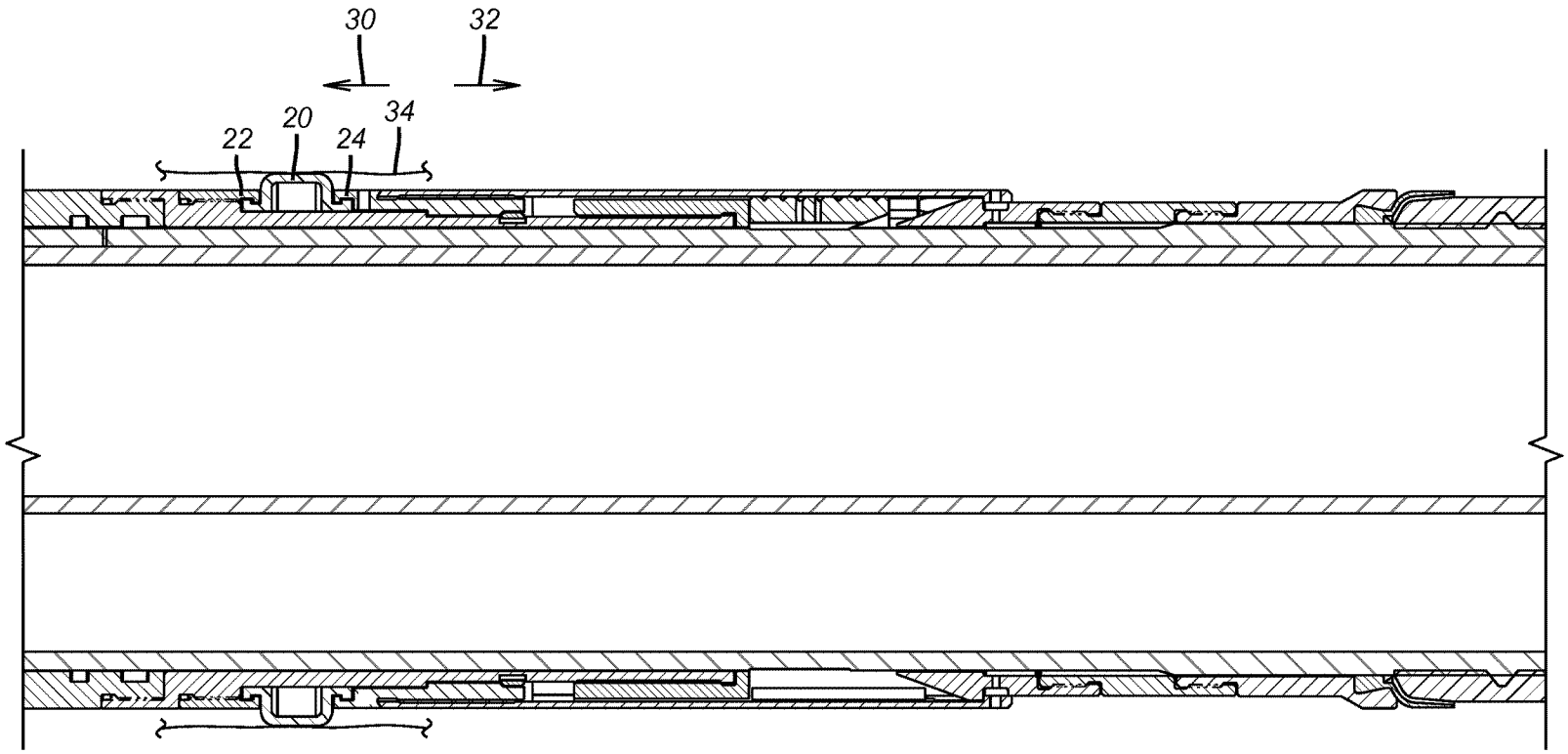
FIG. 2 is the view of FIG. 1 with the debris barrier extended and locked before the slips and seal are extended.
Figure 3:
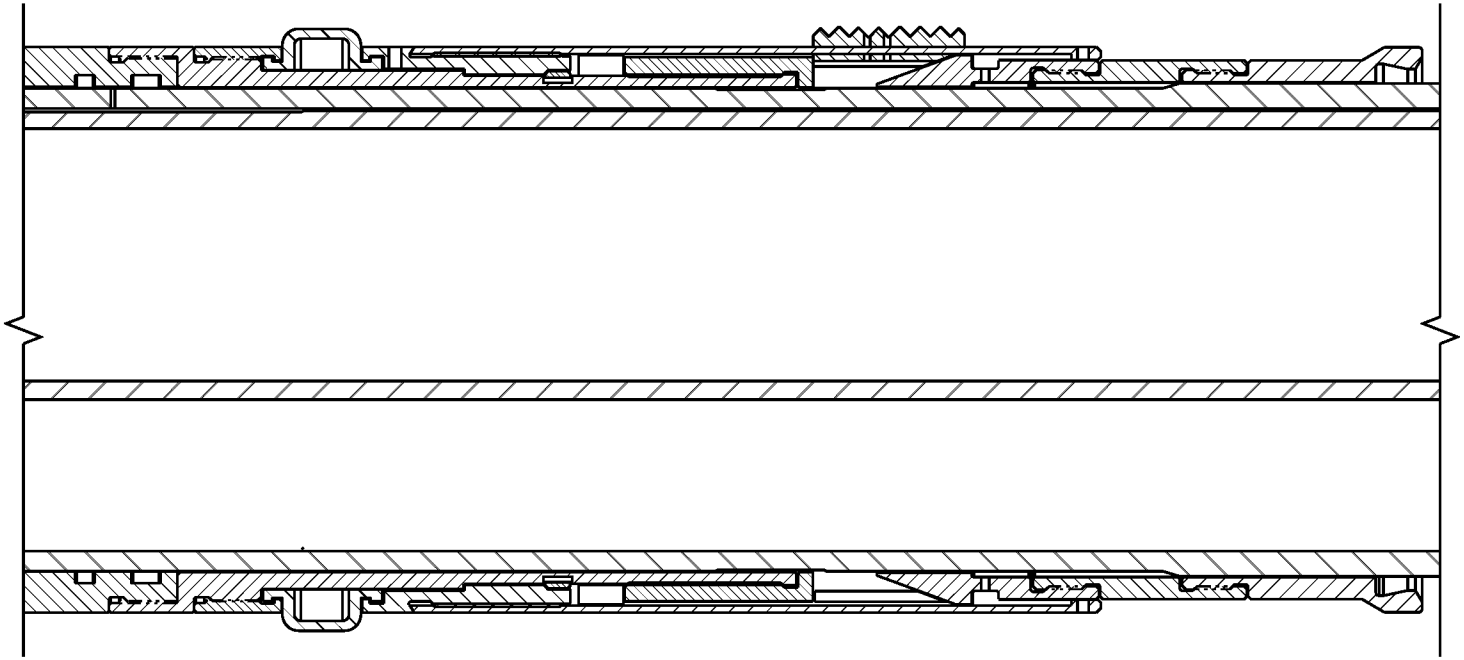
FIG. 3 is the view of FIG. 2 with the slip and seal in the set position.
Figure 4:
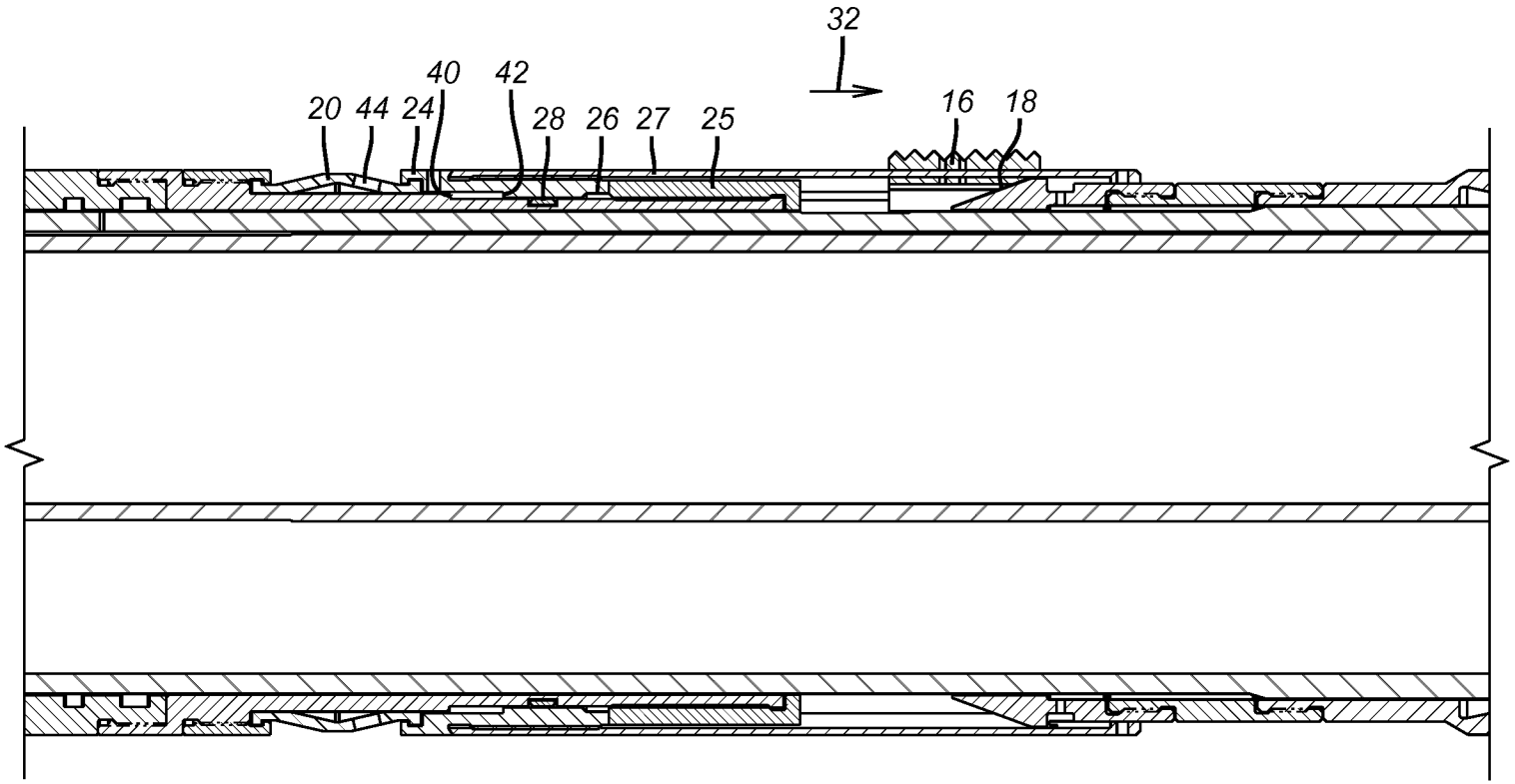
FIG. 4 is the view of FIG. 3 with the debris barrier extended and retracted before the slip is released.

Referring to FIG. 1 a packer 10 of a known design has a sealing element 12 as well as a backup ring 14 and upper slips 16 that ride on a cone 18. A debris barrier 20 is mounted between end rings 22 and 24. As rings 22 and 24 are brought toward each other a groove 26, a new feature of the packer 10, is moved into alignment with a c-ring or snap ring 28 that is biased toward the groove 26. This is shown in the FIG. 2 where ring 24 has moved in the direction of arrow 30 and cannot come back in the direction of arrow 32. The debris barrier is now against the surrounding tubular 34. At this point with the barrier 20 against the tubular 24 additional axial compression of the outer assembly of the packer can take place which results in extension of the upper slip 16 followed by the seal 12 and then a lower slip that is not shown. This can be seen when comparing FIG. 3 to FIG. 2. Release of the packer is accomplished with an upward pull to break a shear ring that is not shown which then allows the outer assembly of the seal and slips that surround it to extend in a downhole direction to then let the slips and seal radially retract for retrieval. As shown in FIG. 4 the groove 26 has shifted with ring 24 to retract the debris barrier 20. Next the slip 16 will resume the FIG. 1 position as the cone 18 relaxes away due to movement in the direction of arrow 32. Although not shown, the slips and low slip assembly will then relax so that the packer can be removed from the borehole. From what is seen in the FIGS. the movement from the ste position of FIG. 3 to the retrieved position of FIG. 4 is characterized by the upper slip cage moving up to contact the slip 16, which provides the back-up needed to collapse the snap ring 28 into its groove. The top of the packer 12 and the internals then move up to close the gap between part 24 and the load ring 25 continuing up until the upper slip cage 27 makes contact with the slip 16 again. The upper slip cage 27 then, in FIG. 4, pulls the slip 16 away from the upper cone 18 allowing the element system to relax.

Note the shoulders 40 and 42 have separated in FIG. 4 as the debris barrier has relaxed. The compression of the debris barrier when set is limited by the contact between shoulders 40 and 42. When these two shoulders contact the snap ring or equivalent 28 lines up with groove 26. Thus the set position of the debris barrier 20 can be locked against relaxation until a shear force is applied to release the locked in compressive force on the outer assembly. When that happens the lock for the debris barrier is defeated to allow the barrier 20 to extend axially with retracting radially as the snap ring 28 is forced back into its original groove and out of groove 26. Through parts shouldering out the removal force for the released packer is not transmitted through the debris barrier 20. One or more openings 44 can be provided in the debris barrier 20 to prevent liquid locking. The debris barrier 20 is preferably rubber or another resilient material that is compatible with well materials and temperatures.

Figure 5:
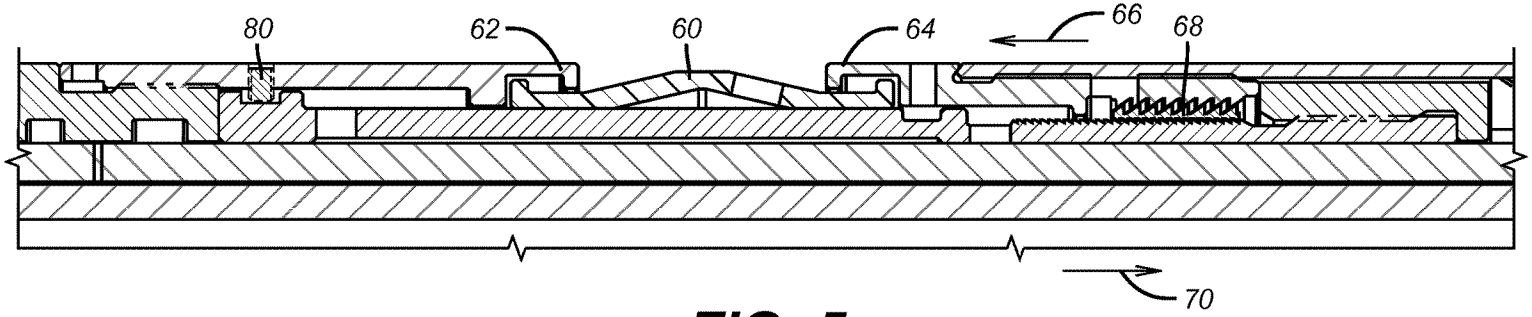
FIG. 5 is a section view in the run in position showing the debris barrier and the body lock ring locking system for the debris barrier.
Figure 6:
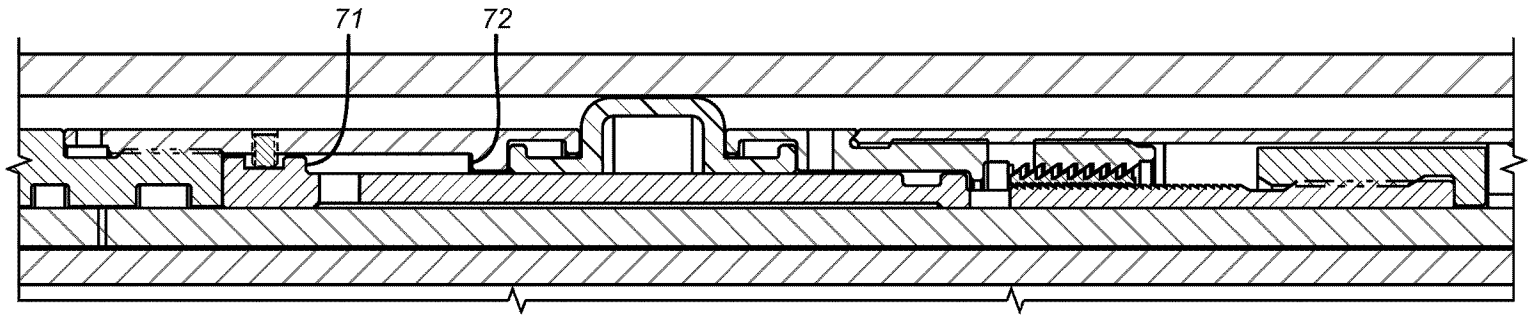
FIG. 6 is the view of FIG. 5 showing the debris barrier extended and locked into position.
Figure 7:
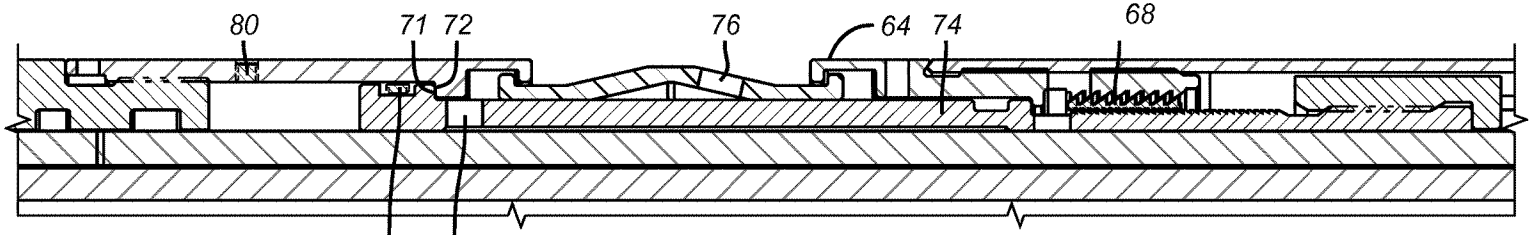
FIG. 7 is the view of FIG. 6 with the debris barrier relaxed when the packer set is released.
Figure 8:
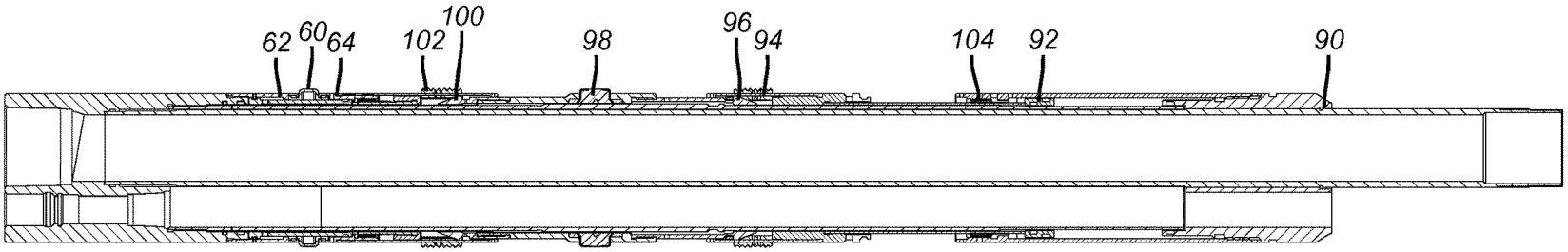
FIG. 8 is an assembly drawing of the packer in FIG. 6 shown in the debris barrier set position.
Figure 9:
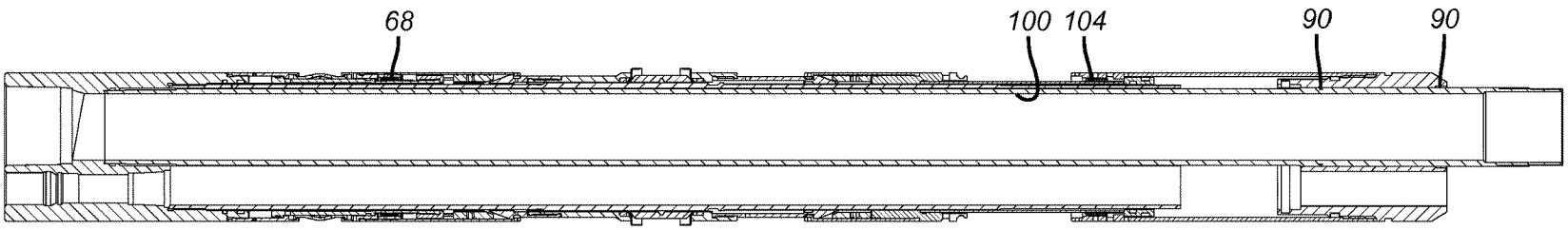
FIG. 9 is the view of FIG. 8 with the debris barrier and the packer in the released position and ready for retrieval.

FIGS. 5-7 show an alternative embodiment in the run in, set and released positions respectively. FIGS. 8 and 9 show the debris barrier in the set and retrieved positions in the context of a complete packer assembly drawing. The debris barrier 60 is extended by bringing rings 62 and 64 together when setting the packer. As ring 64 moves up in the direction of arrow 66 it takes with it lock ring 68 that can ratchet up in the direction of arrow 66 but cannot move in the opposite direction of arrow 70. Shoulders 71 and 72 are spaced apart in the set position of FIG. 6 and are engaged for the retracted position of the barrier 60 to allow retrieval as shown in FIG. 7. When the packer seal and slips are released, as will be explained below, the lock ring 68 does not release. Instead a shear release of the packer allows rings 64 and 74 to move in tandem with the lock ring 68 so that the debris barrier can extend axially while retracting radially. This movement continues until shoulders 71 and 72 engage as shown in FIG. 7 as the packer seal 12 extends in an uphole direction. The barrier 60 can have one or more openings 76 to prevent liquid locking as the set position of FIG. 6 is accomplished. Openings 78 accomplish a similar purpose. A shear pin 80 can hold ring 62 and 74 together until the release of the packer where it breaks as shown in FIG. 7.

FIG. 8 shows the assembly of the entire packer which apart from the components described in FIGS. 5-7 is of a known design. The release of the packer is accomplished by shearing l-shaped shear ring 90. Setting is accomplished with pressure on piston 92 which pushes up lower slips 94 and cone 96, seal 98, cone 100, upper slips 102 and ring 64 against barrier 60 against ring 62 which cannot move. As a result of axial force from piston 92 the above parts below ring 62 move up. Lock ring 104 ratchets to hold the ultimate set position. As the piston 92 moves the debris barrier 60 is extended and its extended position locked by lock ring 68. Continued movement of piston 92 pushes cone 100 under upper slips 102 and that extends the slips 102 to the surrounding tubular. Thereafter, the seal 98 is set and then the slips 94 are pushed up ramp 96 thus holding the seal 98 in its set position against differential forces in opposed directions. The set of the slips 94 and 102 and the seal 98 are separately locked by the lock ring 104. As shown in FIG. 9 release is accomplished with a force applied to mandrel which defeats the lock ring assemblies 104 to release the packer and 68 to release the debris barrier 60. Again, the basic packer as described in FIGS. 8 and 9 is known apart from the application of the debris barrier and the locking of the debris barrier in a releasable manner. While the locking for the debris barrier 60 is accomplished with a lock ring assembly that engages when the packer is set and releases when the packer is released, other types of releasable locks are contemplated. To facilitate the packer design, the debris barrier 60 is extended and locked into position first as the rest of the packer components are then actuated and releasably locked. Other operating orders are contemplated. Of course, preferred placement of the barrier such as 60 is uphole from the packer components to keep falling debris from the borehole wall or in the drilling or well fluids out of the close fitting components that could jam.

While the context of the debris barrier has been described as with packers or bridge plug, other applications are envisioned such as valves, cutters, mills or any other tools with close fitting relatively moving components that could jam with debris found in a borehole. Debris barriers that set in a variety of ways are contemplated. These ways are with set down weight or with an uphole force using a setting piston or in either direction with a tool run into the borehole. The sequence can be the debris barrier is set with, before or after the tool is operated. The barrier can be set with motion in the same or the opposite direction than is used to set the tool. In essence the set position of the debris barrier is releasably locked, however, if the tool is not to be retrieved then the lock on the set position need not be releasable. The debris barrier is protected from tensile stress in the run in and retrieval of the packer or bridge plug with the debris barrier retracted.

The above description is illustrative of the preferred embodiment and many modifications may be made by those skilled in the art without departing from the invention whose scope is to be determined from the literal and equivalent scope of the claims below:

We claim:

1. A tool assembly for subterranean use, comprising:

a multicomponent tool comprising relatively moving elements selectively releasable from a set position with defeat of a multicomponent tool lock;

a debris barrier associated with said tool having a retracted position away from a surrounding borehole wall for running in said tool and an extended position where said debris barrier spans between said tool and a surrounding borehole wall;

said debris barrier locked with a debris barrier lock in said extended position against return to said retracted position when said multicomponent tool is in said set position;

said debris barrier lock remaining locked until relative multicomponent movement initially defeats said multicomponent tool lock so that the multicomponent tool can first relax from said set position while said debris barrier remains locked.

2. The assembly of claim 1, wherein:

said debris barrier, after said debris barrier lock is defeated resumes said retracted position.

3. The assembly of claim 1, wherein:

said debris barrier lock comprises a snap ring compressed in a first groove that expands into a second groove upon alignment of said grooves.

4. The assembly of claim 3, wherein:

said multicomponent tool is operated when as said grooves align.

5. The assembly of claim 4, wherein:

said multicomponent tool is operated to misalign said grooves.

6. The assembly of claim 5, wherein:

said snap ring is forced from said second groove back into said first groove when said tool is operated a second time.

7. The assembly of claim 6, wherein:

said tool comprises a packer or bridge plug.

8. The assembly of claim 7, wherein:

said packer or bridge plug sets before, during or after said debris barrier is moved to said extended position;

said debris barrier is locked in said extended position when said first and second grooves align.

9. The assembly of claim 8, wherein:

said first and second grooves misalign due to unsetting the packer or bridge plug.

10. The assembly of claim 1, wherein:

said tool comprises a packer or bridge plug.

11. The assembly of claim 1, wherein:

said debris barrier lock comprises a ratcheting lock ring.

12. The assembly of claim 11, wherein:

said multicomponent tool comprises a packer or bridge plug.

13. The assembly of claim 12, wherein:

said packer or bridge plug is selectively locked with said multicomponent tool lock further comprising a ratcheting lock ring.

14. The assembly of claim 13, wherein:

said packer or bridge plug shearably unset to defeat said multicomponent tool lock to allow said debris barrier to retract after continuing movement of said multicomponent tool defeats said debris barrier lock, which allows said packer or bridge plug to be retrieved.

15. The assembly of claim 1, wherein:

said debris barrier is moved the extended position by relative movement between two opposed retaining rings.

16. The assembly of claim 15, wherein:

said debris barrier comprises a resilient member that folds between said retaining rings and further comprises at least one wall opening.

17. The assembly of claim 16, wherein:

said debris barrier is protected from tensile stress in said retracted position.

18. The assembly of claim 17, wherein:

said multicomponent tool comprises a retrievable packer or bridge plug.

19. The assembly of claim 18, wherein:

said debris barrier lock is releasably locked with a snap ring or a ratcheting lock ring.

20. The assembly of claim 19, wherein:

said bridge plug or packer is shearably released before further movement of said multicomponent tool releases said snap ring or to bypass the hold of said ratcheting lock ring associated with said debris barrier.

* * * * *